US011398689B2

(12) United States Patent
Nakamura

(10) Patent No.: US 11,398,689 B2
(45) Date of Patent: Jul. 26, 2022

(54) CONNECTING METHOD, CONNECTING STRUCTURE, CONTACT AND CONNECTOR

(71) Applicant: Japan Aviation Electronics Industry, Limited, Tokyo (JP)

(72) Inventor: Keisuke Nakamura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/803,334

(22) Filed: Feb. 27, 2020

(65) Prior Publication Data

US 2020/0366010 A1 Nov. 19, 2020

(30) Foreign Application Priority Data

May 17, 2019 (JP) ..... JP2019-093645

(51) Int. Cl.

| | |
|---|---|
| ***H01R 12/59*** | (2011.01) |
| ***H01R 12/61*** | (2011.01) |
| ***H01R 12/77*** | (2011.01) |
| ***H01R 13/24*** | (2006.01) |
| ***H01R 12/79*** | (2011.01) |
| *H01R 107/00* | (2006.01) |

(52) U.S. Cl.

CPC ..... *H01R 12/592* (2013.01); *H01R 12/613* (2013.01); *H01R 12/771* (2013.01); *H01R 12/79* (2013.01); *H01R 13/24* (2013.01); *H01R 2107/00* (2013.01)

(58) Field of Classification Search

CPC .... H01R 12/592; H01R 13/24; H01R 12/613; H01R 12/771; H01R 12/79

See application file for complete search history.

(56) References Cited

U.S. PATENT DOCUMENTS

| | | | | |
|---|---|---|---|---|
| 5,069,625 | A * | 12/1991 | Brandt | H01R 43/01 439/404 |
| 6,931,727 | B2 | 8/2005 | Bulmer et al. | |
| 7,112,087 | B2 * | 9/2006 | Tago | H01R 43/24 439/495 |
| 2001/0035297 | A1 * | 11/2001 | Tamai | H01B 7/0009 174/133 R |
| 2002/0176674 | A1 * | 11/2002 | Auclair | G02B 6/46 385/101 |

(Continued)

FOREIGN PATENT DOCUMENTS

| | | | |
|---|---|---|---|
| EP | 3376601 | A1 | 9/2018 |
| JP | 2017182897 | A | 10/2017 |

OTHER PUBLICATIONS

European Search Report dated Jun. 24, 2020 in EP Application No. 20164342.6.

(Continued)

*Primary Examiner* — Jean F Duverne

(74) *Attorney, Agent, or Firm* — Muncy, Geissler, Olds & Lowe, P.C.

(57) ABSTRACT

A first connection portion is formed at an end portion of a flexible conductor by folding the end portion of the flexible conductor in halves along a folding line extending in a given direction, and a contact-side connection portion of a contact presses the first connection portion from opposite sides in a thickness direction of the first connection portion to thereby electrically connect the contact to the flexible conductor.

8 Claims, 10 Drawing Sheets

(56) References Cited

U.S. PATENT DOCUMENTS

| | | | | |
|---|---|---|---|---|
| 2003/0016509 | A1 | 1/2003 | Tsukamoto | |
| 2014/0213119 | A1* | 7/2014 | Thackston ..... | H01R 24/62<br>439/676 |
| 2017/0279105 | A1 | 9/2017 | Zhao et al. | |
| 2017/0279230 | A1 | 9/2017 | Komoto et al. | |
| 2018/0175564 | A1 | 6/2018 | Komoto et al. | |

OTHER PUBLICATIONS

European Office Action dated Mar. 11, 2021 in EP Application No. 20 164 342.6, 11 pages.

* cited by examiner

CONNECTING METHOD, CONNECTING STRUCTURE, CONTACT AND CONNECTOR

BACKGROUND OF THE INVENTION

The present invention relates to a connecting method, in particular, to a connecting method for electrically connecting a contact having conductivity to a flexible conductor extending in a given direction.

The present invention also relates to a connecting structure, a contact and a connector.

As a structure of connecting a contact to a conductive portion of a flexible substrate, for example, JP2017-182897A discloses a connector as shown in FIG. 31. The connector comprises a base member 1 in a circular disk shape and a frame member 2 in an annular shape, and cloth 3 of a garment is sandwiched from opposite sides by the base member 1 and the frame member 2, whereby the connector is attached to the cloth 3.

In the cloth 3, a circular opening portion 4 is formed, and on the rear surface of the cloth 3, a plurality of band-shaped conductive portions 5 are arranged radially about the opening portion 4. The frame member 2 is also provided with a circular opening portion 6 having a substantially same size as that of the opening portion 4 in the cloth 3.

The base member 1 holds a plurality of contacts 7, and each of the contacts 7 is provided with a contact portion 7A at one end thereof and an external connection portion 7B at the other end thereof. Contact portions 7A of the contacts 7 are exposed on the front surface of the base member 1 while being arranged in the circumferential direction to form a circle with a smaller diameter than those of the opening portion 4 of the cloth 3 and the opening portion 6 of the frame member 2. External connection portions 7B of the contacts 7 are exposed on and project from the front surface of the base member 1 in a vicinity of the outer periphery of the base member 1.

In the vicinity of the outer periphery of the base member 1 on its front surface, a plurality of projections 8 are formed to project from the front surface of the base member 1, whereas the rear surface of the frame member 2 is provided with a plurality of fitting holes (not shown) corresponding to the external connection portions 7B of the contacts 7 and the projections 8.

The front surface of the base member 1 is brought into contact with the rear surface of the cloth 3, the base member 1 is aligned to the frame member 2, and the rear surface of the frame member 2 is brought into contact with the front surface of the cloth 3 such that one end of each of the conductive portions 5 near the opening portion 4 of the cloth 3 comes into contact with the corresponding external connection portion 7B of the base member 1; in this state, the frame member 2 is firmly pressed to the base member 1. Accordingly, the external connection portions 7B and the projections 8 of the base member 1 are fitted in the corresponding fitting holes of the frame member 2, with the cloth 3 being sandwiched therebetween, whereby the connector is attached to the cloth 3.

In this process, the conductive portions 5 of the cloth 3 are pressed into the corresponding fitting holes of the frame member 2 while being in contact with the external connection portions 7B of the corresponding contacts 7 of the base member 1 and are thus electrically connected to the contacts 7.

Meanwhile, the external connection portions 7B of the contacts 7 disposed in the vicinity of the outer periphery of the front surface of the base member 1 are connected to one ends of the corresponding band-shaped conductive portions 5 that are radially arranged on the rear surface of the cloth 3, resulting in a problem that the arrangement pitch of the contacts 7 becomes large.

Although it would be possible to reduce the arrangement pitch of the contacts 7 by reducing the width of the band-shaped conductive portions 5 that are arranged on the rear surface of the cloth 3, it is required to ensure a certain width of the conductive portions 5 from the perspective of an amount of electrical conduction and conduction reliability, and therefore it has been difficult to configure a miniaturized connector.

In particular, since the conductive portions 5 comprising cloth conductors made of, for example, conductive fibers have the lower conductivity compared to a metallic conductor and have the smaller effective contact area compared to the occupancy area of the conductive portions 5 due to the uneven profile of its contact surface, the conductive portions 5 need to have a sufficient width, and therefore it is difficult to narrow the arrangement pitch of the contacts 7.

SUMMARY OF THE INVENTION

The present invention has been made in order to solve the conventional problem described above and is aimed at providing a connecting method for electrically connecting a contact having conductivity to a flexible conductor while realizing a narrower arrangement pitch when a plurality of contacts are arranged.

The present invention also aims at providing a connecting structure obtained by use of the connecting method, as well as a contact and a connector for use in the connecting method.

A connecting method according to the present invention is a connecting method for electrically connecting a contact having conductivity to a flexible conductor extending in a given direction, the connecting method comprising:

forming a first connection portion at an end portion of the flexible conductor by folding the end portion of the flexible conductor in halves along a folding line extending in the given direction; and pressing the first connection portion with a contact-side connection portion of the contact from opposite sides in a thickness direction of the first connection portion to thereby electrically connect the contact to the flexible conductor.

A connecting structure according to the present invention is a connecting structure in which a contact having conductivity is electrically connected to a flexible conductor extending in a given direction, wherein the flexible conductor includes a first connection portion that is formed by folding an end portion of the flexible conductor in halves along a folding line extending in the give direction, wherein the contact includes a contact-side connection portion, and wherein the first connection portion is pressed with the contact-side connection portion from opposite sides in a thickness direction of the first connection portion to thereby electrically connect the contact to the flexible conductor.

A contact according to the present invention is a contact having conductivity that is to be electrically connected to a flexible conductor extending in a given direction, the contact comprising:

a contact-side connection portion to be connected to a first connection portion that is formed at an end portion of the flexible conductor by folding the end portion of the flexible conductor in halves along a folding line extending in the given direction, wherein the contact-side connection portion presses the first connection portion from opposite sides in a thickness direction of the first connection portion to be electrically connected to the flexible conductor.

A connector according to the present invention comprises:

a plurality of contacts having conductivity;

a plurality of flexible conductors connected to the plurality of contacts and each extending in a given direction; and a housing for holding the plurality of contacts, wherein each contact of the plurality of contacts includes:

a contact-side connection portion that is disposed at an end of the each contact and connected to a corresponding flexible conductor;

a contact portion that is disposed at another end of the each contact and comes into contact with a corresponding contact of a counter connector when the connector is fitted with the counter connector along a fitting axis; and a holding portion that is disposed between the contact-side connection portion and the contact portion and is embedded in and held by the housing, wherein each flexible conductor of the plurality of flexible conductors includes:

a first connection portion that is formed by folding an end portion lying in the given direction of the each flexible conductor in halves along a folding line extending in the given direction; and a second connection portion that is disposed at another end portion in the given direction of the each flexible conductor, and wherein the contact-side connection portion of the each contact presses the first connection portion of a corresponding flexible conductor from opposite sides in a thickness direction of the first connection portion, whereby the plurality of contacts are electrically connected to the plurality of flexible conductors.

DETAILED DESCRIPTION OF THE INVENTION

Embodiments of the present invention are described below based on the appended drawings.

Embodiment 1

Figure 1:
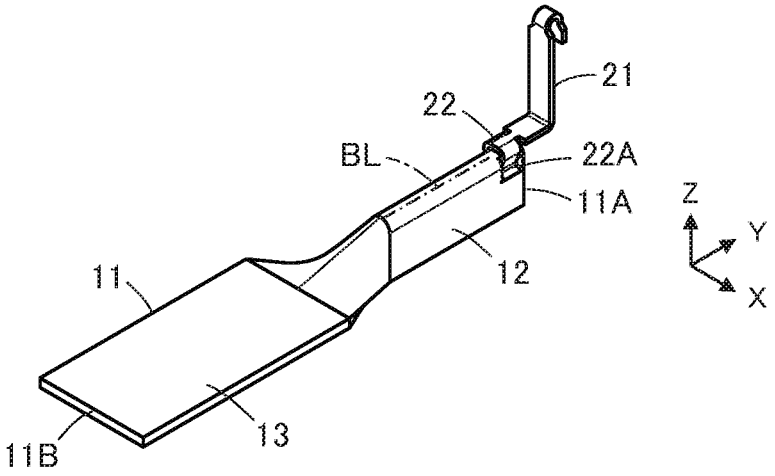
FIG. 1 is a perspective view showing a connecting structure according to Embodiment 1.
Figure 2:
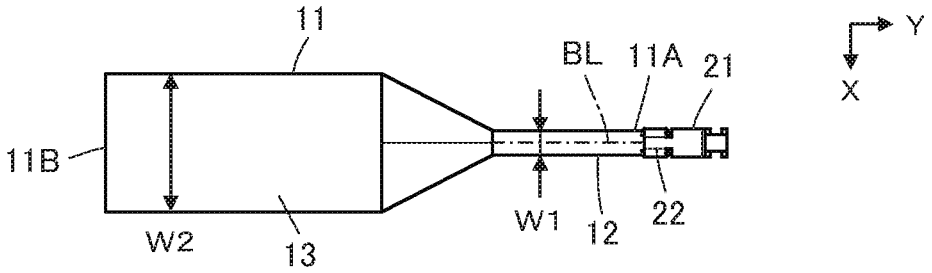
FIG. 2 is a plan view showing the connecting structure according to Embodiment 1.
Figure 3:
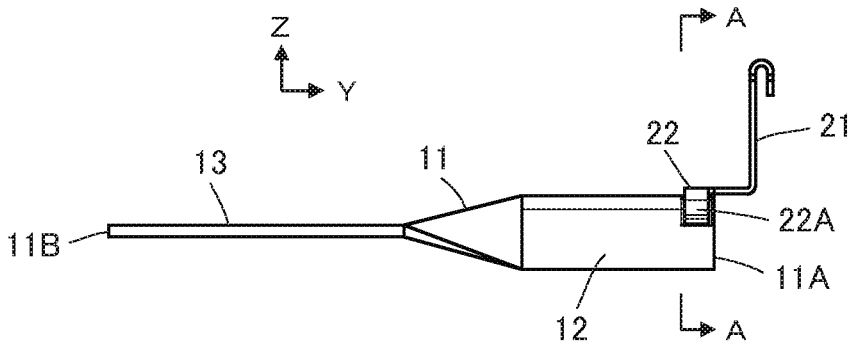
FIG. 3 is a side view showing the connecting structure according to Embodiment 1.

FIGS. 1 to 3 illustrate a connecting structure according to Embodiment 1. In the connecting structure, a contact 21 having conductivity is connected to an end portion (tip portion) 11A of a flexible conductor 11 extending in a given direction.

The flexible conductor 11 comprises conductive fibers formed into a band shape extending from the end portion 11A to the other end portion 11B, and a first connection portion 12 is disposed at the end portion 11A, while a second connection portion 13 is disposed at the other end portion 11B. The first connection portion 12 is formed of the end portion 11A of the flexible conductor 11 that is folded in halves along a folding line BL extending in the given direction. The second connection portion 13 disposed at the other end portion 11B of the flexible conductor 11 is not folded in halves but planarly extends.

The contact 21 includes a contact-side connection portion 22 formed at one end of the contact 21, and the first connection portion 12 of the flexible conductor 11 is pressed with the contact-side connection portion 22 from opposite sides in the thickness direction of the first connection portion 12, whereby the contact 21 is electrically connected to the flexible conductor 11.

For ease of understanding, a plane along which the other end portion 11B of the flexible conductor 11 extends is called "XY plane," the given direction in which the flexible conductor 11 extends from the other end portion 11B toward the end portion 11A of the flexible conductor 11 "+Y direction," and a direction extending perpendicularly to the XY plane "Z direction."

The flexible conductor 11 is folded in halves along the folding line BL so that the resulting first connection portion 12 formed at the end portion 11A of the flexible conductor 11 has a flat plate shape extending along the YZ plane. Accordingly, as illustrated in FIG. 2, while the second connection portion 13 disposed at the other end portion 11B of the flexible conductor 11 and planarly extending along the XY plane without being folded has a width W2 in the X direction, the first connection portion 12 formed at the end portion 11A of the flexible conductor 11 has a width W1 in the X direction that is narrower than the width W2 of the second connection portion 13.

Figure 4:
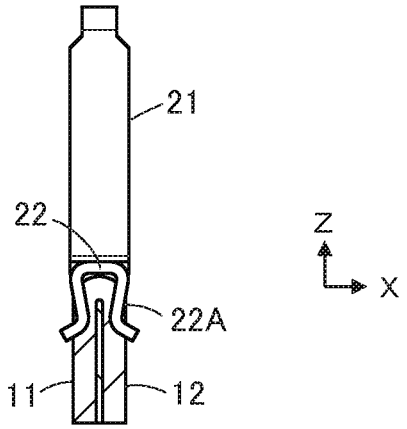
FIG. 4 is a cross-sectional view taken along line A-A in FIG. 3.

The contact-side connection portion 22 of the contact 21 includes a pair of nipping pieces 22A independently disposed on the +X direction side and on the −X direction side of the first connection portion 12 of the flexible conductor 11. As illustrated in FIG. 4, the first connection portion 12 of the flexible conductor 11 is sandwiched between and pressed by the pair of nipping pieces 22A from opposite sides in the X direction that is the thickness direction of the first connection portion 12, so as to be in contact with the pair of nipping pieces 22A while being compressed in the X direction.

Next, a method of manufacturing a connecting structure according to Embodiment 1 is described.

Figure 5:
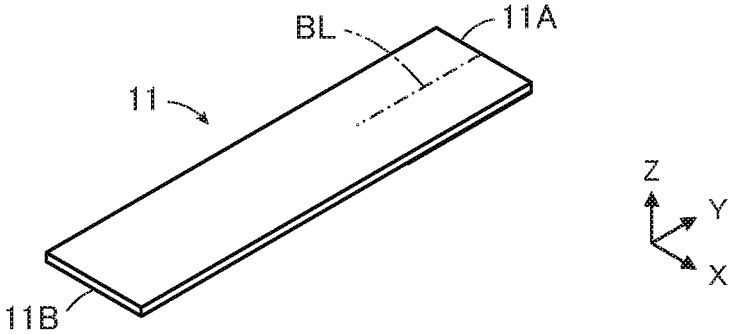
FIG. 5 is a perspective view of a flexible conductor for use in the connecting structure of Embodiment 1 when viewed from an obliquely upper position.
Figure 6:
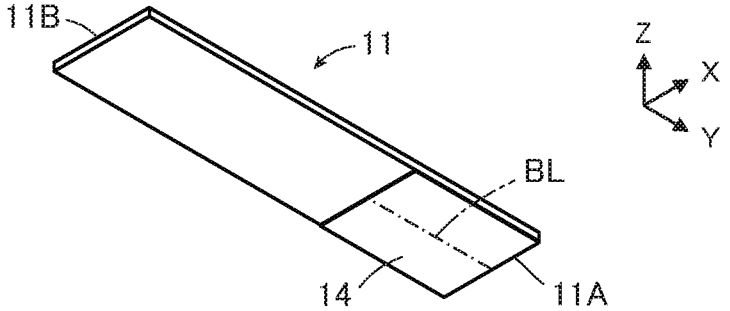
FIG. 6 is a perspective view of the flexible conductor for use in the connecting structure of Embodiment 1 when viewed from an obliquely lower position.

As illustrated in FIGS. 5 and 6, at the end portion 11A of the flexible conductor 11 comprising conductive fibers formed into a band shape extending in the Y direction, the folding line BL is defined to extend in the Y direction on the center line of the X directional width of the flexible conductor 11. Here, the rear surface, facing the −Z direction, of the end portion 11A of the flexible conductor 11 is coated with an adhesive 14.

Figure 7:
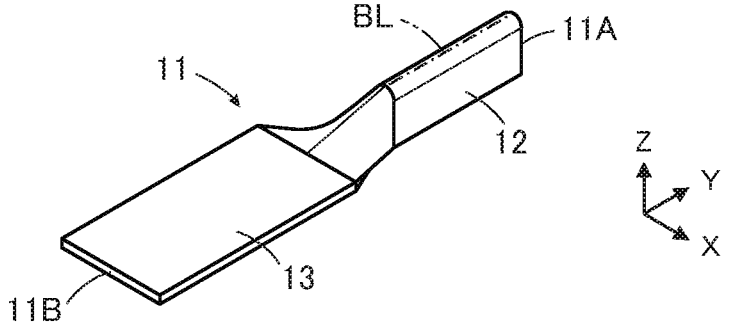
FIG. 7 is a perspective view showing the flexible conductor for use in the connecting structure of Embodiment 1 with an end portion thereof being folded in halves.
Figure 8:
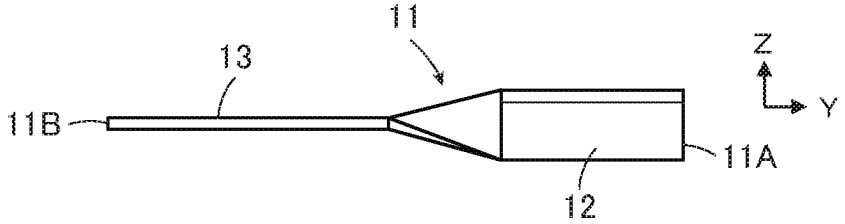
FIG. 8 is a side view showing the flexible conductor for use in the connecting structure of Embodiment 1 with the end portion thereof being folded in halves.

Then, the end portion 11A of the flexible conductor 11 is folded in halves along the folding line BL such that the front surface, facing the +Z direction, of the flexible conductor 11 forms a convex shape, and halves of the rear surface of the flexible conductor 11 are superposed to face each other. The flexible conductor 11 made of conductive fibers have the fiber direction in the Y direction that coincides with the folding line BL, which helps the flexible conductor 11 to be readily folded. Since the rear surface of the end portion 11A of the flexible conductor 11 is coated with the adhesive 14, the halves of the rear surface are bonded together to form the first connection portion 12 in a flat plate shape extending along the YZ plane at the end portion 11A of the flexible conductor 11, as illustrated in FIGS. 7 and 8.

Figure 9:
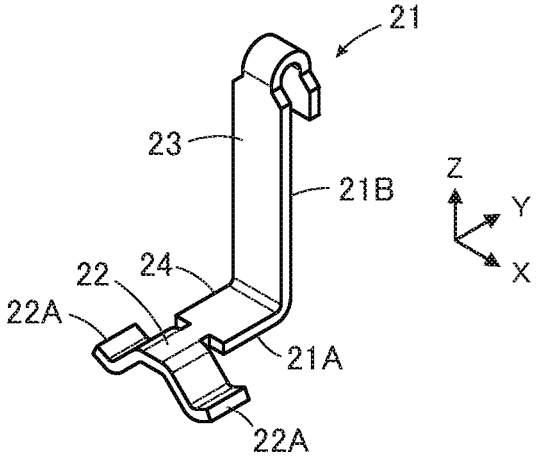
FIG. 9 is a perspective view showing a contact for use in the connecting structure of Embodiment 1 in an unconnected state.

The contact 21 is formed of a metal sheet that is bent into a substantially L shape and includes a first extension portion 21A extending in the Y direction and a second extension portion 21B extending from the +Y directional end of the first extension portion 21A in the +Z direction, as illustrated in FIG. 9. The contact-side connection portion 22 is disposed at the −Y directional end of the first extension portion 21A, a contact portion 23 is disposed on the +Z direction side in the second extension portion 21B, and a holding portion 24 is disposed between the contact-side connection portion 22 and the contact portion 23.

The pair of nipping pieces 22A of the contact-side connection portion 22 separately extend in opposite directions, i.e., in the +X direction and the −X direction.

The end portion of the contact portion 23 is bent into a U shape at the +Z directional end of the second extension portion 21B.

Figure 10:
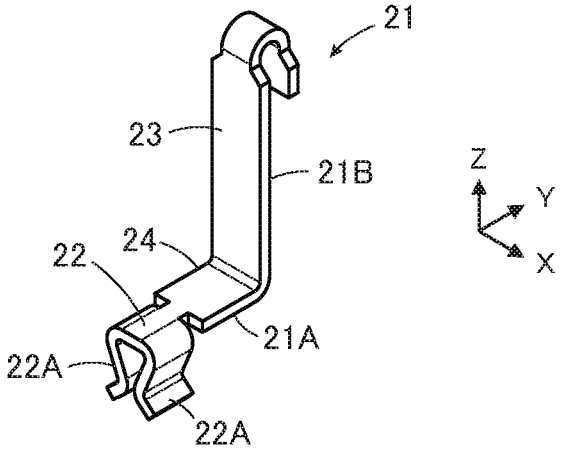
FIG. 10 is a perspective view showing the contact for use in the connecting structure of Embodiment 1 in a connected state.

While the contact 21 is aligned with respect to the flexible conductor 11 such that the contact-side connection portion 22 including the pair of nipping pieces 22A that separately extend in opposite directions comes into contact with the +Y directional end of the first connection portion 12 of the flexible conductor 11 at the edge of the first connection portion 12 on the +Z direction side, the pair of nipping pieces 22A are bent in the −Z direction to nip the first connection portion 12 as illustrated in FIG. 10 to press the first connection portion 12 from opposite sides in the thickness direction of the first connection portion 12 that is the X direction. Accordingly, the connecting structure in which the contact 21 is electrically connected to the flexible conductor 11 as illustrated in FIGS. 1 to 4 is obtained.

Since the flexible conductor 11 is connected to the contact 21 in such a manner that the end portion 11A of the flexible conductor 11 is folded in halves along the folding line BL to form the first connection portion 12 in a flat plate shape extending along the YZ plane and that the contact-side connection portion 22 of the contact 21 presses the first connection portion 12 from opposite sides in the thickness direction of the first connection portion 12 that is the X direction, the occupancy area of the first connection portion 12 as viewed from the Z direction can be reduced, while the effective contact area between the flexible conductor 11 and the contact 21 can be secured.

FIGS. 11 to 14 illustrate a connector that is configured using the connecting structure according to Embodiment 1. The connector is to be fitted with a counter connector that is not shown along a fitting axis C1 extending in the Z direction and includes a plurality of contacts 21 arranged in the X direction in two rows and a housing 31 for holding the contacts 21. In each row, the contacts 21 are arranged in the X direction that is orthogonal to the fitting axis C1 at an arrangement pitch P. To the contacts 21, independently connected are a plurality of flexible conductors 11 that are arranged substantially radially about the fitting axis C1 within the XY plane that is perpendicular to the fitting axis C1. Each of the contacts 21 is connected to the corresponding flexible conductor 11 by means of the connecting structure as shown in FIGS. 1 to 4.

A value of the arrangement pitch P of the contacts 21 is set such that the arrangement pitch P is wider than the width W1 of each of the first connection portions 12 of the flexible conductors 11 and narrower than the width W2 of each of the second connection portions 13 of the flexible conductors 11 when viewed in the direction along the fitting axis C1.

In addition, the connector includes an exterior member 41 covering the periphery of the housing 31 from the +Z direction, a circular upper cover 51 entirely covering the radially-arranged flexible conductors 11 from the +Z direction, and a circular lower cover 61 covering the first connection portions 12 of the radially-arranged flexible conductors 11 from the −Z direction.

The housing 31 and the exterior member 41 are made of an insulating resin, while the upper cover 51 and the lower cover 61 are made of flexible insulating fibers or a flexible insulating resin film.

Figure 13:
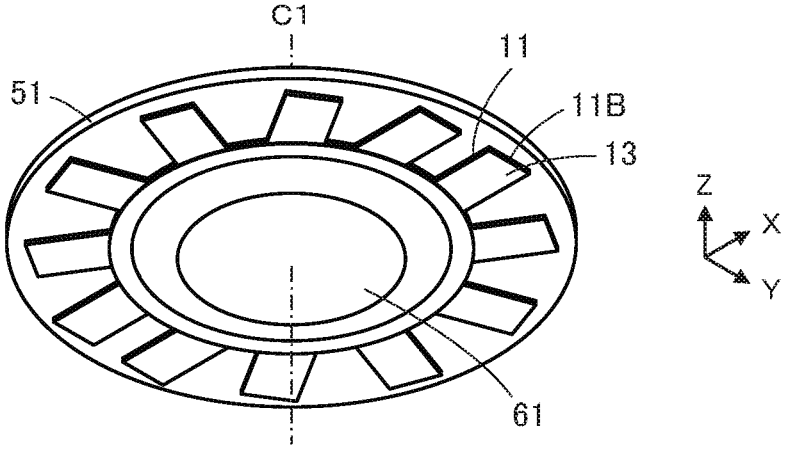
FIG. 13 is a perspective view of the connector using the connecting structure of Embodiment 1 when viewed from an obliquely lower position.
Figure 14:
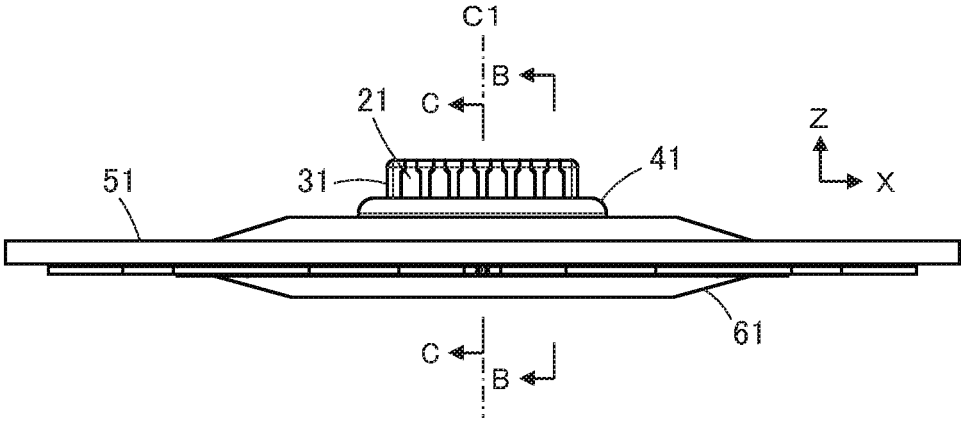
FIG. 14 is a side view showing the connector using the connecting structure of Embodiment 1.

The lower cover 61 has a diameter smaller than that of the upper cover 51, and as illustrated in FIG. 13, the second connection portions 13 disposed at the other end portions 11B of the flexible conductors 11 are not covered by the lower cover 61 but are exposed. The upper cover 51 and the lower cover 61 together constitute a cover member that covers the first connection portions 12 of the flexible conductors 11 but allows the second connection portions 13 of the flexible conductors 11 to be exposed.

Figure 11:
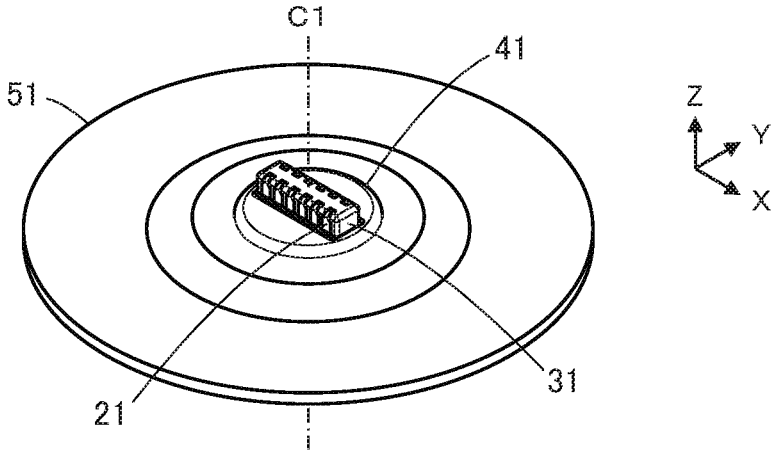
FIG. 11 is a perspective view of a connector using the connecting structure of Embodiment 1 when viewed from an obliquely upper position.
Figure 12:
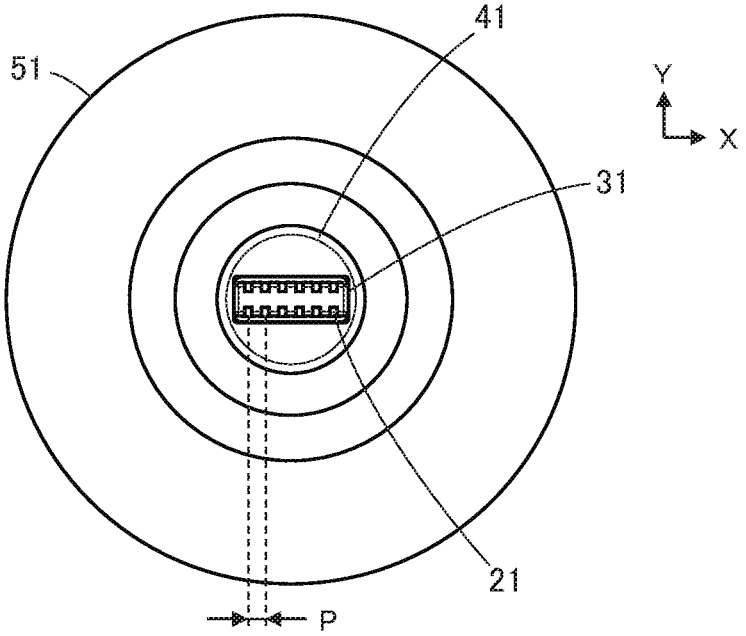
FIG. 12 is a plan view showing the connector using the connecting structure of Embodiment 1.
Figure 15:
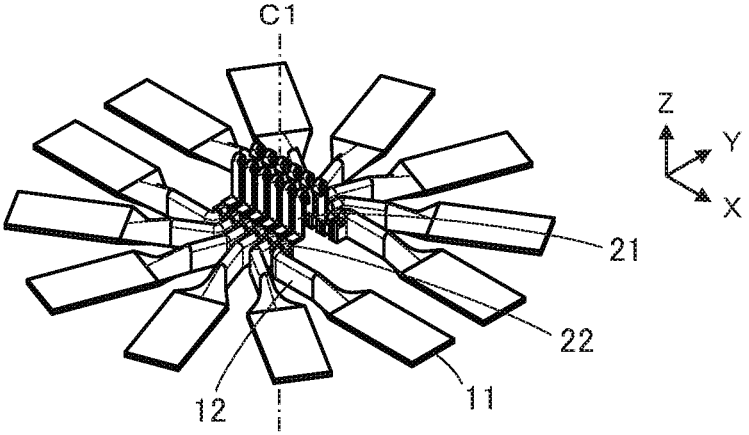
FIG. 15 is a perspective view of a plurality of connecting structures arranged in the connector when viewed from an obliquely upper position.
Figure 16:
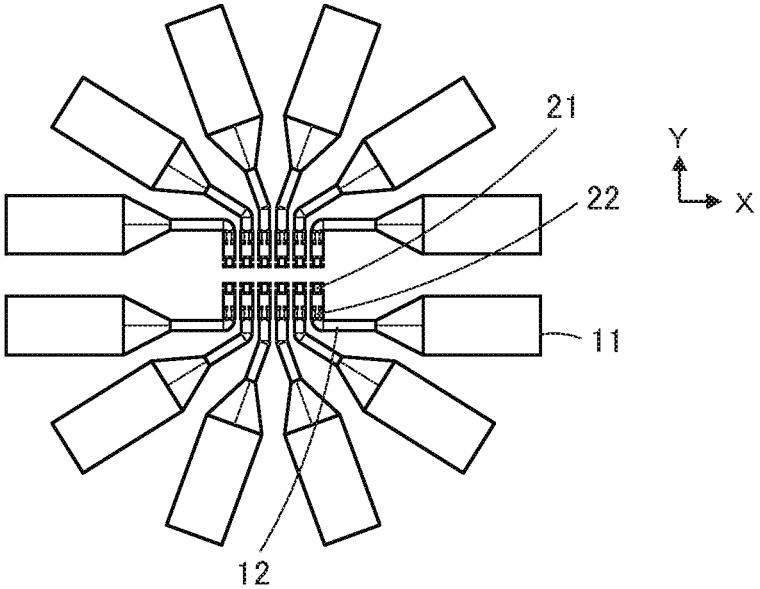
FIG. 16 is a plan view showing the plurality of connecting structures arranged in the connector.
Figure 17:
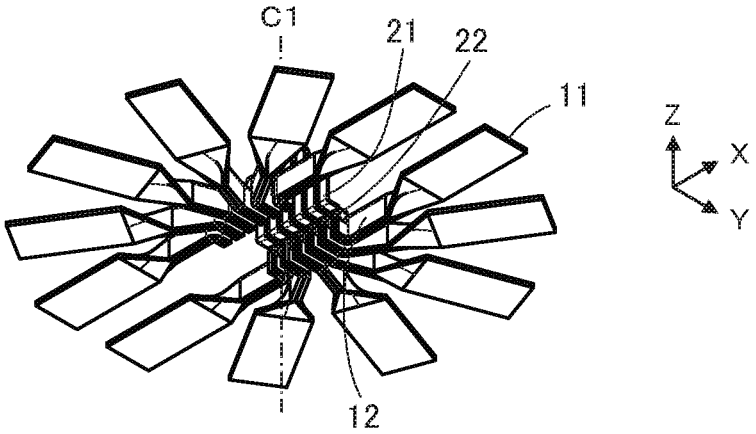
FIG. 17 is a perspective view of the plurality of connecting structures arranged in the connector when viewed from an obliquely lower position.

FIGS. 15 to 17 illustrate only a plurality of connecting structures that are arranged in the connector, where illustration of the housing 31, the exterior member 41, the upper cover 51 and the lower cover 61 of the connector shown in FIGS. 11 to 13 is omitted. In each connecting structure, the contact-side connection portion 22 of the contact 21 is connected to the first connection portion 12 of the corresponding flexible conductor 11. While the contacts 21 are arranged in the X direction in two rows, the first connection portions 12 of the flexible conductors 11 connected to the contacts 21 are each bent within the XY plane so that the second connection portions 13 of the flexible conductors 11 are arranged in a circumferential direction so as to form a substantially circular shape about the fitting axis C1 within the XY plane that is perpendicular to the fitting axis C1.

Figure 18:
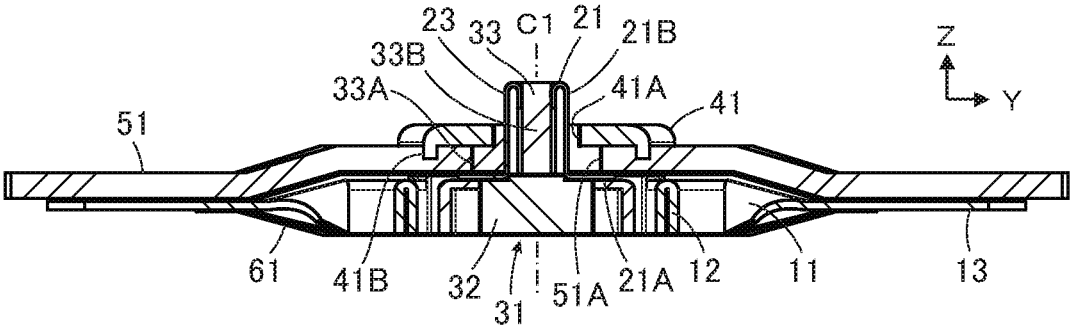
FIG. 18 is a cross-sectional view taken along line B-B in FIG. 14.
Figure 19:
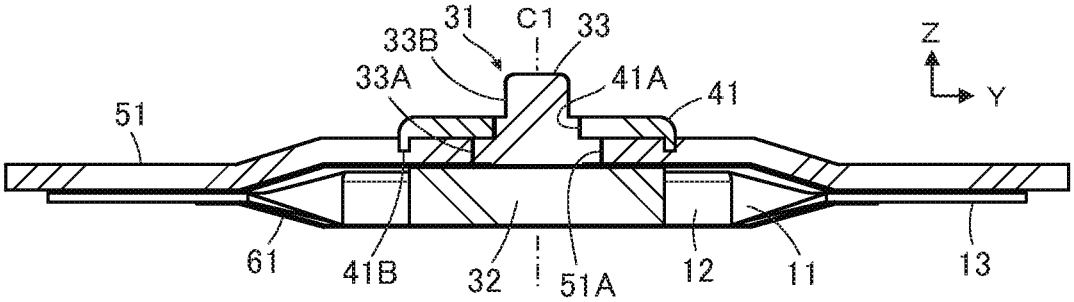
FIG. 19 is a cross-sectional view taken along line C-C in FIG. 14.

As illustrated in FIGS. 18 and 19, the housing 31 comprises a lower insulator 32 and an upper insulator 33 that is disposed on the lower insulator 32.

The first connection portions 12 of the flexible conductors 11, to which the contact-side connection portions 22 of the corresponding contacts 21 are separately connected, are held by the lower insulator 32, and the second extension portions 21B of the contacts 21 are held by the upper insulator 33.

Figure 20:
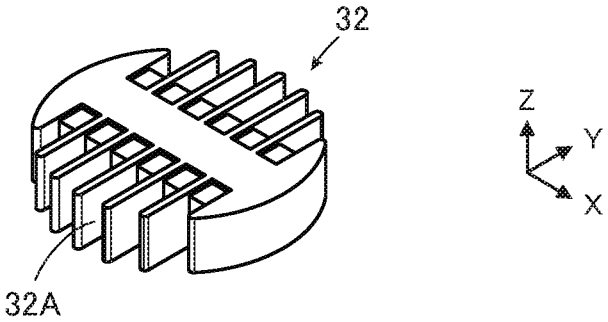
FIG. 20 is a perspective view showing a lower insulator of a housing used in the connector.
Figure 21:
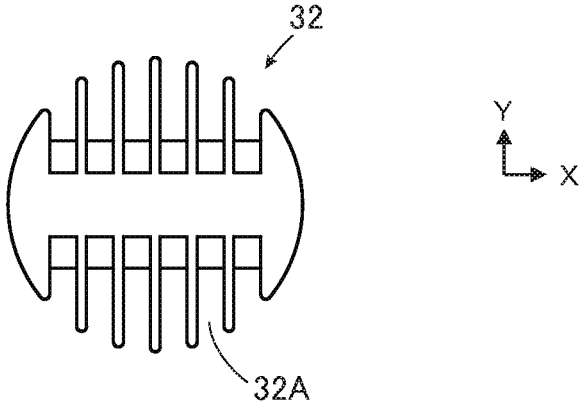
FIG. 21 is a plan view showing the lower insulator of the housing used in the connector.

As illustrated in FIGS. 20 and 21, the lower insulator 32 has a circular disk shape extending along the XY plane, and a part of the lower insulator 32 on the +Y direction side and another part on the −Y direction side are each provided with a plurality of slots 32A extending in the Y direction and arranged in the X direction at equal intervals. The slots 32A are for receiving and holding the first connection portions 12 of the flexible conductors 11.

Figure 22:
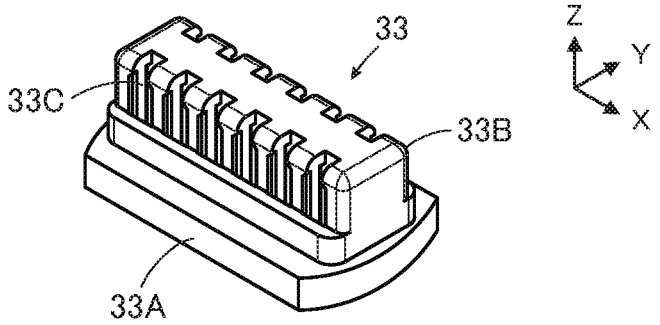
FIG. 22 is a perspective view of an upper insulator of the housing used in the connector when viewed from an obliquely upper position.
Figure 23:
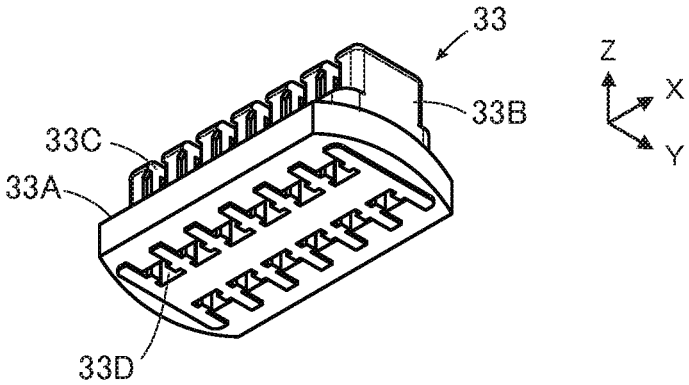
FIG. 23 is a perspective view of the upper insulator of the housing used in the connector when viewed from an obliquely lower position.

As illustrated in FIGS. 22 and 23, the upper insulator 33 includes a base portion 33A in a flat plate shape extending along the XY plane and a projection portion 33B in a substantially cuboid shape projecting from the base portion 33A in the +Z direction and extending in the X direction. A part of the projection portion 33B on the +Y direction side and another part on the −Y direction side are each provided with a plurality of contact-holding grooves 33C extending in the Z direction, and the base portion 33A is provided with a plurality of through holes 33D independently communicating with the contact-holding grooves 33C of the projection portion 33B. The contact-holding grooves 33C and the through holes 33D are for holding the second extension portions 21B of the contacts 21.

The contact-holding grooves 33C and the through holes 33D are provided in the upper insulator 33 so as to independently correspond to the slots 32A of the lower insulator 32. In other words, the upper insulator 33 and the lower insulator 32 are configured such that, when the upper insulator 33 is disposed on the lower insulator 32, the slots 32A of the lower insulator 32 independently communicate with the corresponding through holes 33D and the corresponding contact-holding grooves 33C of the upper insulator 33.

Figure 24:
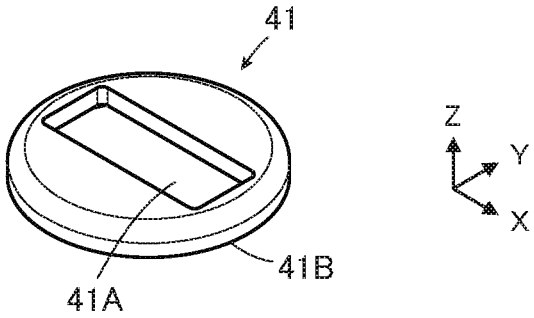
FIG. 24 is a perspective view of an exterior member used in the connector when viewed from an obliquely upper position.
Figure 25:
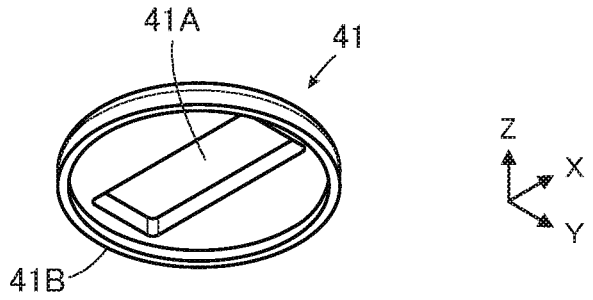
FIG. 25 is a perspective view of the exterior member used in the connector when viewed from an obliquely lower position.

As illustrated in FIGS. 24 and 25, the exterior member 41 covering the periphery of the housing 31 from the +Z direction has a circular disk shape extending along the XY plane and is provided at the center part thereof with a rectangular opening portion 41A extending in the X direction and at the outer periphery thereof with an annular projection 41B projecting in the −Z direction. The opening portion 41A has a size that allows the projection portion 33B of the upper insulator 33 of the housing 31 to be inserted therethrough.

With the contacts 21 independently connected to the corresponding flexible conductors 11 being arranged in the X direction in two rows as illustrated in FIGS. 15 to 17, the upper insulator 33 can be formed integrally with the contacts 21 using a mold that is not shown. The holding portion 24 of each contact 21 is placed in the corresponding through hole 33D in the upper insulator 33, and the contact portion 23 is held in the corresponding contact-holding groove 33C of the upper insulator 33 and is exposed outward from the projection portion 33B of the upper insulator 33.

The lower insulator 32 preliminarily formed by molding an insulating resin is moved from the −Z direction toward the +Z direction until the lower insulator 32 comes into contact with the surface of the upper insulator 33 on the −Z direction side, and the first connection portions 12 of the flexible conductors 11 connected to the contact-side connection portions 22 of the contacts 21 are independently inserted into the corresponding slots 32A of the lower insulator 32, whereby the housing 31 holding the contacts 21 is formed.

Subsequently, as illustrated in FIGS. 18 and 19, all the flexible conductors 11 extending substantially radially about the fitting axis C1 are covered by the circular upper cover 51 from the +Z direction, the first connection portions 12 of the flexible conductors 11 are covered by the circular lower cover 61 from the −Z direction, and the exterior member 41 is placed on the upper cover 51 from the +Z direction, while the projection portion 33B of the upper insulator 33 projects from the opening portion 41A of the exterior member 41 in the +Z direction.

At the center of the upper cover 51, an opening portion 51A to receive the base portion 33A of the upper insulator 33 is formed, and the upper cover 51 is disposed over the lower insulator 32, the first extension portions 21A of the contacts 21 and the flexible conductors 11, while the exterior member 41 is disposed over the base portion 33A of the upper insulator 33 and the upper cover 51. In addition, the lower cover 61 is disposed on the −Z direction side of the lower insulator 32 and the first connection portions 12 of the flexible conductors 11.

The connector as illustrated in FIGS. 11 to 14 is manufactured in this manner.

The connecting structure used in the connector manufactured in this manner connects the flexible conductor 11 to the contact 21 by pressing the first connection portion 12 in a flat plate shape that is formed by folding the end portion 11A of the flexible conductor 11 in halves along the folding line BL, from opposite sides in the thickness direction of the first connection portion 12, with the contact-side connection portion 22 of the contact 21 as illustrated in FIGS. 1 to 3. Accordingly, when the plurality of contacts 21 independently connected to the corresponding flexible conductors 11 are arranged in a direction orthogonal to the fitting axis C1 so that the flexible conductors 11 are arranged substantially radially about the fitting axis C1 within a plane perpendicular to the fitting axis C1, the arrangement pitch P of the contacts 21 can be narrower than the width W2 of the second connection portion 13 of each flexible conductor 11, thus enabling to narrow the arrangement pitch of the contacts 21.

The connector shown in FIGS. 11 to 14 can be used, for example, as a connector for a so-called wearable device when the connector is attached to a garment and the second connection portions 13 of the flexible conductors 11 are electrically connected to a plurality of conductive members provided on the garment.

While the halves of the rear surface of the flexible conductor 11 that is folded along the folding line BL are bonded together with the adhesive 14 coated on the rear surface of the end portion 11A of the flexible conductor 11, the adhesive 14 may be replaced by, for example, a double-sided adhesive tape to bond the halves of the rear surface together.

Although the folded halves of the rear surface of the flexible conductor 11 need not be bonded together, it is preferable that the halves of the rear surface of the flexible conductor 11 are bonded together in order to prevent the first connection portions 12 of neighboring flexible conductors 11 from short-circuiting when the contacts 21 independently connected to the corresponding flexible conductors 11 are arranged at the arrangement pitch P.

The upper insulator 33 of the housing 31 is integrally formed with the plurality of contacts 21, but this is not the sole case. Also, by pressing the contacts 21 into the upper insulator 33 that has been preliminarily formed by molding an insulating resin, the configuration where the plurality of contacts 21 are held by the upper insulator 33 can be realized.

To the contacts 21 that have been incorporated into the upper insulator 33, the first connection portions 12 of the flexible conductors 11 independently corresponding to the contact-side connection portions 22 of the contacts 21 may be connected.

Embodiment 2

Figure 26:
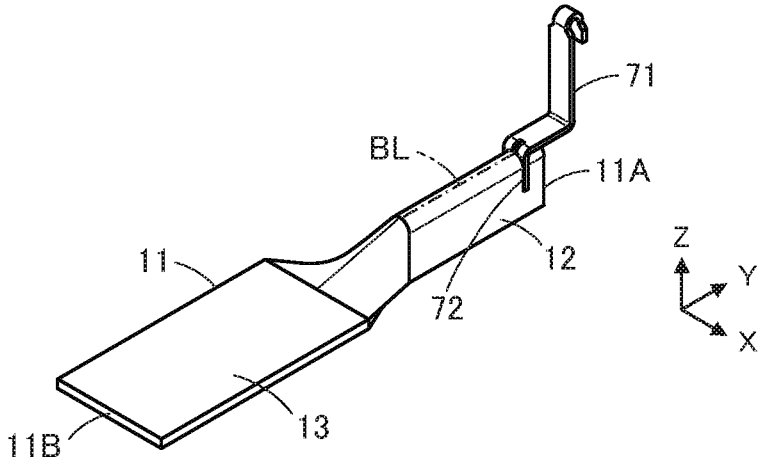
FIG. 26 is a perspective view showing a connecting structure according to Embodiment 2.
Figure 27:
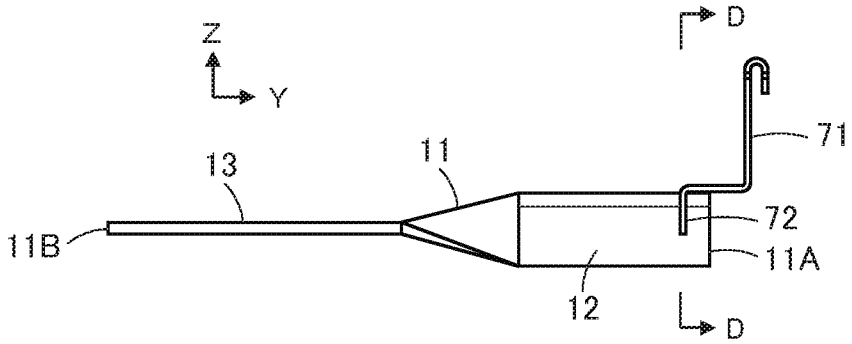
FIG. 27 is a side view showing the connecting structure according to Embodiment 2.
Figure 28:
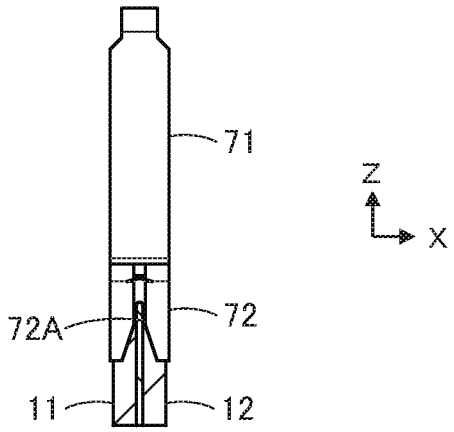
FIG. 28 is a cross-sectional view taken along line D-D in FIG. 27.

FIGS. 26 to 28 illustrate a connecting structure according to Embodiment 2. In the connecting structure, the first connection portion 12 of the flexible conductor 11 used in Embodiment 1 is connected to a contact 71 having conductivity.

The contact 71 includes a contact-side connection portion 72 formed at one end of the contact 71, and the first connection portion 12 of the flexible conductor 11 is inserted into a slit 72A formed in the contact-side connection portion 72, whereby the contact 71 is electrically connected to the flexible conductor 11.

Figure 29:
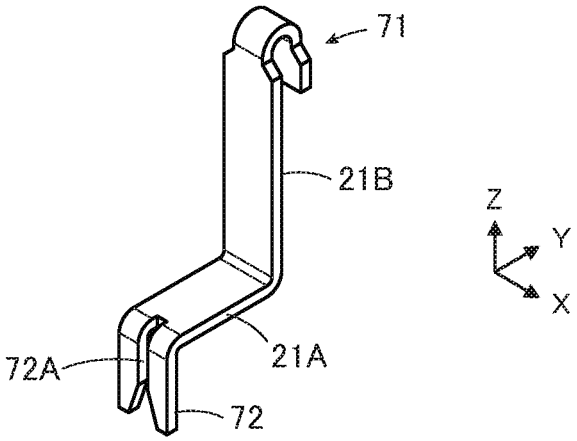
FIG. 29 is a perspective view showing a contact for use in the connecting structure of Embodiment 2.

As illustrated in FIG. 29, the contact 71 is provided with, in place of the contact-side connection portion 22 of the contact 21 used in Embodiment 1, the contact-side connection portion 72 at the −Y directional end of the first extension portion 21A and otherwise has the same configuration as that of the contact 21.

The contact-side connection portion 72 bends from the −Y directional end of the first extension portion 21A toward the −Z direction to extend in the Z direction, and the slit 72A is formed from the −Z directional end of the contact-side connection portion 72 and extends in the Z direction.

When the first connection portion 12 of the flexible conductor 11 is inserted into the slit 72A, the first connection portion 12 is pressed with the inner faces of the slit 72A from opposite sides in the thickness direction of the first connection portion 12 that is the X direction, whereby the flexible conductor 11 and the contact 71 are electrically connected to each other.

With use of the connecting structure of Embodiment 2, it is also possible to narrow the arrangement pitch of a plurality of contacts 71 in the same manner as in Embodiment 1.

Embodiment 3

Figure 30:
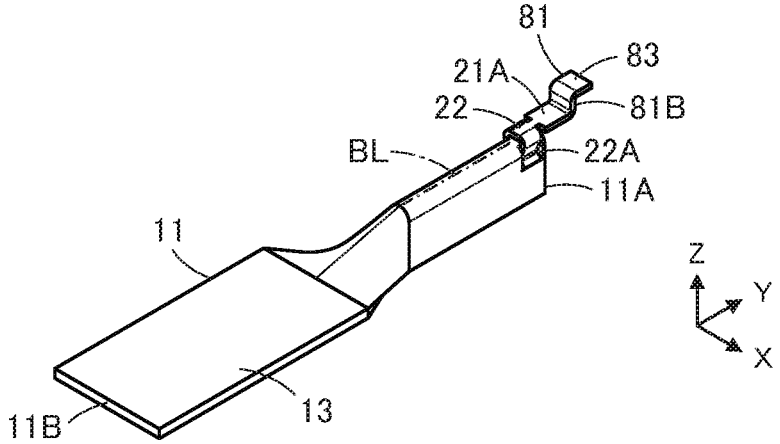
FIG. 30 is a perspective view showing a connecting structure according to Embodiment 3.
Figure 31:
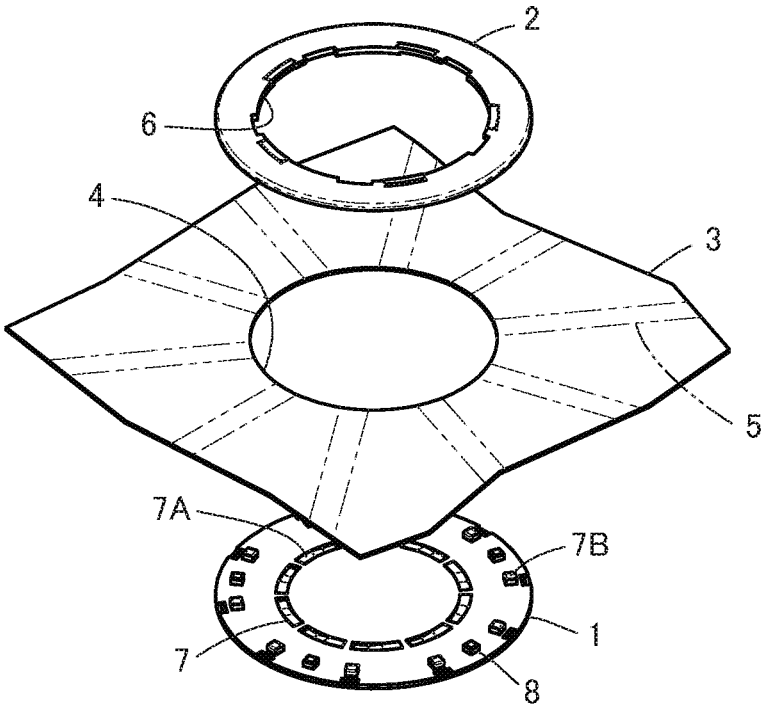
FIG. 31 PRIOR ART
FIG. 31 is an exploded perspective view showing a conventional connector.

FIG. 30 illustrates a connecting structure according to Embodiment 3. In the connecting structure of Embodiment 3, the first connection portion 12 of the flexible conductor 11 used in Embodiment 1 is connected to a contact 81 having conductivity.

The contact 81 includes, in place of the second extension portion 21B of the contact 21 used in Embodiment 1, a second extension portion 81B having a shorter length in the Z direction than that of the second extension portion 21B, which second extension portion 81B is joined to the +Y directional end of the first extension portion 21A, and otherwise has the same configuration as that of the contact 21.

The +Z directional end of the second extension portion 81B bends toward the +Y direction and is provided with a planar contact portion 83 facing the +Z direction. The contact portion 83 is to be connected to a conductive portion of a circuit board (not shown) that extends along the XY plane on the +Z direction side of the contact 81 through soldering, for example.

With use of the connecting structure of Embodiment 3, the flexible conductor 11 can be connected to a circuit board and, at the same time, it is possible to narrow the arrangement pitch of a plurality of contacts 81 in the same manner as in Embodiment 1.

Note that the contact 81 achieves electrical connection with the flexible conductor 11 by pressing the pair of nipping pieces 22A of the contact-side connection portion 22 against the first connection portion 12 of the flexible conductor 11 from opposite sides in the thickness direction of the first connection portion 12 that is the X direction, as with the contact 21 used in Embodiment 1. In the meantime, the contact 81 may include, in place of the contact-side connection portion 22, the contact-side connection portion 72 having the slit 72A as with the contact 71 in Embodiment 2. Also with such configuration, the flexible conductor 11 can be connected to a circuit board, and at the same time, it is possible to narrow the arrangement pitch of a plurality of contacts 81.

Moreover, the shape of the contact portion 83 of the contact 81 is not limited to that illustrated in FIG. 30 and can take on a variety of shapes.

What is claimed is:

1. A connector comprising:

a plurality of contacts having conductivity;

a plurality of flexible conductors connected to the plurality of contacts and each extending in a given direction; and a housing for holding the plurality of contacts, wherein each contact of the plurality of contacts includes:

a contact-side connection portion that is disposed at an end of the each contact and connected to a corresponding flexible conductor;

a contact portion that is disposed at another end of the each contact and comes into contact with a corresponding contact of a counter connector when the connector is fitted with the counter connector along a fitting axis; and a holding portion that is disposed between the contact-side connection portion and the contact portion and is embedded in and held by the housing, wherein each flexible conductor of the plurality of flexible conductors includes:

a first connection portion that is formed by folding an end portion lying in the given direction of the each flexible conductor in halves along a folding line extending in the given direction; and a second connection portion that is disposed at another end portion in the given direction of the each flexible conductor, and wherein the contact-side connection portion of the each contact presses the first connection portion of a corresponding flexible conductor from opposite sides in a thickness direction of the first connection portion, whereby the plurality of contacts are electrically connected to the plurality of flexible conductors, wherein the plurality of conductive contacts are arranged in a direction orthogonal to the fitting axis, wherein the plurality of flexible conductors extend substantially radially about the fitting axis within a plane perpendicular to the fitting axis such that the second connection portions of the plurality of flexible conductors are arranged in a circumferential direction to form a substantially circular shape about the fitting axis within the plane perpendicular to the fitting axis, wherein the first connection portion of the each flexible conductor has a width W1 that is narrower than a width W2 of a corresponding second connection portion when viewed from a direction along the fitting axis, wherein an arrangement pitch P of the plurality of contacts is wider than the width W1 of the first connection portion of the each flexible conductor and narrower than the width W2 of the second connection portion of the each flexible conductor when viewed from the direction along the fitting axis.

2. The connector according to claim 1, wherein the second connection portions of the plurality of flexible conductors are aligned in a circumferential direction about the fitting axis within the plane perpendicular to the fitting axis.

3. The connector according to claim 1, wherein the plurality of flexible conductors are made of conductive fibers.

4. The connector according to claim 1, further comprising a cover member covering the first connection portion of the each flexible conductor that is connected to the contact-side connection portion of the each contact while allowing the second connection portion of the each flexible conductor to be exposed.

5. The connector according to claim 1, wherein the first connection portion is formed by folding the end portion lying in the given direction of the each flexible conductor in halves along the folding line extending in the given direction such that the halves of a rear surface of the flexible conductor are superposed to face each other.

6. The connector according to claim 1, wherein the halves of the end portion of the flexible conductor folded along the folding line are bonded together to form the first connection portion.

7. The connector according to claim 1, wherein the contact is formed of a metal sheet, wherein the contact-side connection portion includes a pair of nipping pieces separately extending in opposite directions, and wherein the pair of nipping pieces are bent to sandwich the first connection portion from opposite sides in a thickness direction of the first connection portion to thereby electrically connect the contact to the first connection portion.

8. The connector according to claim 1, wherein the contact is formed of a metal sheet, wherein the contact-side connection portion includes a slit, and wherein the first connection portion is inserted into the slit to thereby electrically connect the contact to the first connection portion.

* * * * *